US006749700B2

(12) United States Patent
Sunakawa et al.

(10) Patent No.: US 6,749,700 B2
(45) Date of Patent: Jun. 15, 2004

(54) METHOD FOR PRODUCING AMORPHOUS ALLOY RIBBON, AND METHOD FOR PRODUCING NANO-CRYSTALLINE ALLOY RIBBON WITH SAME

(75) Inventors: Jun Sunakawa, Shimane-ken (JP); Yoshio Bizen, Shimane-ken (JP); Michihiro Nagao, Tottori-ken (JP)

(73) Assignee: Hitachi Metals Ltd., Tokyo (JP)

( * ) Notice: Subject to any disclaimer, the term of this patent is extended or adjusted under 35 U.S.C. 154(b) by 17 days.

(21) Appl. No.: 10/073,148

(22) Filed: Feb. 13, 2002

(65) Prior Publication Data

US 2003/0041931 A1 Mar. 6, 2003

(30) Foreign Application Priority Data

Feb. 14, 2001 (JP) ..... 2001-036999

(51) Int. Cl.[7] ..... C22C 45/00
(52) U.S. Cl. ..... 148/561; 164/463
(58) Field of Search ..... 148/561; 164/463

(56) References Cited

U.S. PATENT DOCUMENTS 4,676,298 A 6/1987 Liebermann et al.
5,456,308 A 10/1995 Yukumoto et al.
5,611,871 A * 3/1997 Yoshizawa et al. ..... 148/108
5,966,064 A * 10/1999 Yoshizawa et al. ..... 148/306
6,299,989 B1 * 10/2001 DeCristofaro et al. ..... 428/637
6,401,799 B1 * 6/2002 Arai et al. ..... 164/463

FOREIGN PATENT DOCUMENTS

| | | |
|---|---|---|
| DE | 266 046 A1 | 3/1989 |
| JP | 59-209457 | 11/1984 |
| JP | 3-219009 | 9/1991 |
| JP | 4-229604 | 8/1992 |
| JP | 8-318352 | 12/1996 |
| JP | 9-153804 | 9/1997 |
| JP | 11-188458 | 7/1999 |

* cited by examiner

*Primary Examiner*—George Wyszomierski
(74) *Attorney, Agent, or Firm*—Sughrue Mion PLLC

(57) ABSTRACT

An amorphous alloy ribbon free from embrittlement and crystallization and having excellent surface conditions and shape in edge portions is produced by (a) preparing an alloy melt having a composition comprising 13 atomic % or less of B and 15 atomic % or less of at least one selected from the group consisting of transition elements of Groups 4A, 5A and 6A, the balance being substantially Fe; (b) ejecting the alloy melt at a temperature from the melting point of the alloy +50° C. to the melting point of the alloy +250° C. through a nozzle onto the cooling roll rotating at a peripheral speed of 35 m/second or less, a distance between a tip end of the nozzle and the cooling roll being 200 $\mu$m or less; (c) starting to supply a gas based on $CO_2$ to the alloy melt after the surface temperature of the cooling roll has become substantially constant; and (d) grinding the cooling roll while supplying the gas based on $CO_2$.

10 Claims, 5 Drawing Sheets

200 µm

200 µm

200 µm

200 µm

200 μm

200 μm

METHOD FOR PRODUCING AMORPHOUS ALLOY RIBBON, AND METHOD FOR PRODUCING NANO-CRYSTALLINE ALLOY RIBBON WITH SAME

FIELD OF THE INVENTION

The present invention relates to a method for producing an amorphous alloy ribbon having excellent surface conditions and shape in edge portions, and a method for producing a nano-crystalline alloy ribbon using such an amorphous alloy ribbon.

PRIOR ART

Liquid-quenching methods are widely known as methods for producing amorphous alloy ribbons for use in magnetic cores, magnetic shields, etc. The liquid-quenching methods include a single roll method, a double roll method, a centrifugal method, etc., and preferable among them from the aspect of productivity and the maintenance of an apparatus is a single roll method in which a molten metal is supplied onto a cooling roll rotating at a high speed and rapidly quenched to form an alloy ribbon.

FIG. 1 shows one example of apparatuses for carrying out the single roll method. An alloy ingot in a crucible 1 is melted by a high-frequency coil 2, and the resultant alloy melt 3 is ejected through a nozzle 4 onto a cooling roll 5 rotating at a high speed and rapidly quenched to form an amorphous alloy ribbon 6. As shown in FIG. 1, for instance, a high-pressure gas such as nitrogen, a compressed air, etc. is supplied from a peeling-gas nozzle 7 in an opposite direction to the rotation direction of the cooling roll 5 immediately after the casting, thereby forcedly peeling the amorphous alloy ribbon 6 from the cooling roll 5.

The amorphous alloy ribbon 6 produced by the above method tends to be provided with small dents called "air pockets" on a side in contact with the cooling roll 5. This is because a gas is entrained into a boundary between a melt pool portion 10 (hereinafter referred to as "paddle") and the cooling roll 5 by the rotation of the cooling roll 5, so that it expands in the paddle 10 until the melt is solidified. Because the formation of such air pockets leads to the roughing of a surface of the ribbon 6, the air pockets should be as few as possible.

Proposed by German Patent DD266046A1, Japanese Patent Laid-Open No. 6-292950, etc. to suppress the formation of air pockets is a method in which a $CO_2$ gas is supplied to the paddle in various directions. This method is advantageous in that it can suppress the formation of air pockets to reduce the surface roughness of a ribbon on a side in contact with the cooling roll.

Alternatively, Japanese Patent Laid-Open No. 59-209457, Japanese Patent Publication No. 1-501924, etc. propose a method for producing an amorphous alloy ribbon in vacuum or in a He atmosphere, a method for producing an amorphous alloy ribbon while flowing a gas having a lower density than the air at normal temperature, such as a heated CO gas, a He gas at normal temperature etc., to the paddle from rearward. Why the formation of air pockets can be suppressed by these methods seems to be the fact that a gas entrained by the rotation of the cooling roll has a reduced density, resulting in decrease in the kinetic pressure of the gas impinging on the paddle, thereby suppressing the vibration of the paddle.

Among the above methods, the method of flowing a $CO_2$ gas to the paddle from rearward (from a side opposite to the side on which the ribbon is formed) is suitable for the mass production of amorphous alloy ribbons from the aspect of production cost and safety.

The total length of an amorphous alloy ribbon continuously produced in one casting lot by a liquid-quenching method generally exceeds 3,000 m. When the resultant amorphous alloy ribbon is wound around a reel after the completion of casting, the ribbon is likely to be twisted. Accordingly, the quenched ribbon should continuously be wound immediately after peeling from the cooling roll.

For instance, Japanese Patent Laid-Open Nos. 8-318352 and 11-188458 disclose a method in which a magnetized reel rotating in an opposite direction to a cooling roll is positioned near the cooling roll to magnetically attract the peeled ribbon, which is continuously wound around the reel.

It is also known that the heat treatment of an amorphous alloy ribbon produced by the above-described methods at a temperature equal to or higher than the crystallization temperature of the alloy can provide a nano-crystalline alloy ribbon having an average particle size of 100 nm or less. Typical alloys capable of forming nano-crystalline alloy ribbons are Fe—Si—B—(Nb, Ti, Hf, Mo, W, Ta)—Cu alloys, Fe—(Co, Ni)—Cu—Si—B—(Nb, W, Ta, Zr, Hf, Ti, Mo) alloys, Fe—(Hf, Nb, Zr)—B alloys, Fe—Cu—(Hf, Nb, Zr)—B alloys, etc. described in Japanese Patent Publication Nos. 4-4393 and 7-74419, Japanese Patent 2,812,574, etc.

The nano-crystalline alloys are not only substantially free from thermal instability unlike the amorphous alloy, but also are subjected to less change with time and have lower magnetostriction and higher permeability than the amorphous alloys, they are used for common-mode choke coils, pulse transformers, leakage breakers, etc.

As a result of experiment to produce an amorphous alloy ribbon 6 using a laboratory-scale apparatus whose casting time is less than 30 seconds while flowing a $CO_2$ gas, the resultant ribbon had excellent surface conditions. However, in a production experiment using a mass-production-scale apparatus, it was found that as the casting time passed, there arose the problems of embrittlement and crystallization in the formed amorphous alloy ribbon that were not observed in the short casting process, though the surface conditions of the amorphous alloy ribbon was improved by the supply of a $CO_2$ gas. In addition to these problems, it has also be found that a new problem of serrated irregular shapes in their edge portions takes place. This phenomenon never occurs even in the long casting process of an amorphous alloy ribbon unless a $CO_2$ gas is supplied.

Because the total length of an amorphous alloy ribbon continuously produced in one casting step by a mass-production apparatus exceeds 3,000 m, the amorphous alloy ribbon is continuously wound around a large reel during the casting from the aspect of efficiency. The ribbon is then divided to proper length that can easily be handled to produce wound cores, etc., and wound around a large number of small reels. At this time, if the ribbon had a serrated irregular shape in its edge portions, the edge portion of the ribbon engages a reel, resulting in extreme difficulty in handling.

The irregular shape of the ribbon in its edge portions also poses inconveniences in the production of a wound core. In the continuous production of a wound core from a ribbon, the winding of the ribbon is often carried out with the edge portions of the ribbon abutting against a plate to make the resultant wound core have a constant height. In this case, too, if the ribbon had a serrated irregular shape in its edge portions, the ribbon engages the abutting plate, thereby making the production of a wound core difficult.

If the ribbon were brittle, breakage, cracking, etc. would be likely to occur in the production of wound cores and laminated cores. In addition, if the ribbon contains coarse crystals, it would have large crystal magnetic anisotropy, resulting in the deterioration of its soft magnetic properties. Further, if an amorphous alloy ribbon having coarse crystals were heat-treated at a temperature equal to or higher than the crystallization temperature of the alloy, the resultant nano-crystalline alloy ribbon would have deteriorated soft magnetic properties.

OBJECTS OF THE INVENTION

Accordingly, an object of the present invention is to provide a method for continuously producing an amorphous alloy ribbon having improved surface conditions on a side in contact with a cooling roll and excellent edge shapes, free from embrittlement and crystallization.

Another object of the present invention is to provide a method for producing a nano-crystalline alloy ribbon by heat-treating such an amorphous alloy ribbon.

DISCLOSURE OF THE INVENTION

As a result of investigating problems such as irregular edge shapes, embrittlement and crystallization occurring as the amount of a ribbon cast increases (as casting continues longer) in the production of an amorphous alloy ribbon with a $CO_2$ gas supplied, the inventors have found that the above problems can be overcome by grinding a cooling roll during the casting. The present invention has been completed based on this finding.

Thus, the method for producing an amorphous alloy ribbon by ejecting an alloy melt onto a cooling roll and rapidly quenching it according to the present invention comprises carrying out the grinding of the cooling roll while supplying a gas based on $CO_2$ near a paddle of said alloy melt during the casting.

The alloy used in the present invention preferably has a composition comprising 13 atomic % or less of B and 15 atomic % or less of at least one selected from the group consisting of transition elements of Groups 4A, 5A and 6A, the balance being substantially Fe. Also, when the amorphous alloy ribbon is to be heat-treated for nano-crystallization, the alloy melt preferably contains 3 atomic % or less of at least one of Cu, Ag and Au.

When a gas based on $CO_2$ is supplied near a paddle of an alloy melt ejected from a nozzle onto a cooling roll immediately after the start of casting, the ribbon tends to be broken. However, when the gas based on $CO_2$ starts to be supplied after the surface temperature of the cooling roll has become substantially constant, the possibility of the breakage of the ribbon substantially decreases. Here, "surface temperature has become substantially constant" means that the variation range of the surface temperature of the cooling roll has become within 10° C. relative to its average temperature. Though the surface temperature of the cooling roll generally starts to elevate immediately after the start of casting, it becomes substantially constant in several seconds to ten and several seconds because heat from the alloy melt gets balanced with heat dissipating from the cooling roll.

The peripheral speed of the cooling roll is preferably 35 m/second or less, more preferably 20–30 m/second. The temperature of the alloy melt is preferably from the melting point of the alloy +50° C. to the melting point of the alloy +250° C., more preferably from the melting point of the alloy +100° C. to the melting point of the alloy +200° C. In addition, the distance from a tip end of a nozzle to a cooling roll is preferably 200 μm or less, more preferably 100–180 μm, further preferably 100–150 μm. Under such casting conditions, it is possible to stably produce an amorphous alloy ribbon having a thickness of 8–25 μm, particularly 8–19 μm.

The preferred method of the present invention for producing an amorphous alloy ribbon by ejecting an alloy melt onto a cooling roll and rapidly quenching it comprises (a) preparing an alloy melt having a composition comprising 13 atomic % or less of B and 15 atomic % or less of at least one selected from the group consisting of transition elements of Groups 4A, 5A and 6A, the balance being substantially Fe; (b) ejecting the alloy melt at a temperature from the melting point of the alloy +50° C. to the melting point of the alloy +250° C. through a nozzle onto the cooling roll rotating at a peripheral speed of 35 m/second or less, a distance between a tip end of the nozzle and the cooling roll being 200 μm or less; (c) starting to supply a gas based on $CO_2$ to the alloy melt after the surface temperature of the cooling roll has become substantially constant; and (d) grinding the cooling roll while supplying the gas based on $CO_2$.

The heat treatment of the amorphous alloy ribbon produced by the above method at a temperature equal to or higher than the crystallization temperature of the alloy can provide a nano-crystalline alloy ribbon having a nano-crystalline structure having an average particle size of 100 nm or less.

DESCRIPTION OF PREFERRED EMBODIMENTS

Figure 1:
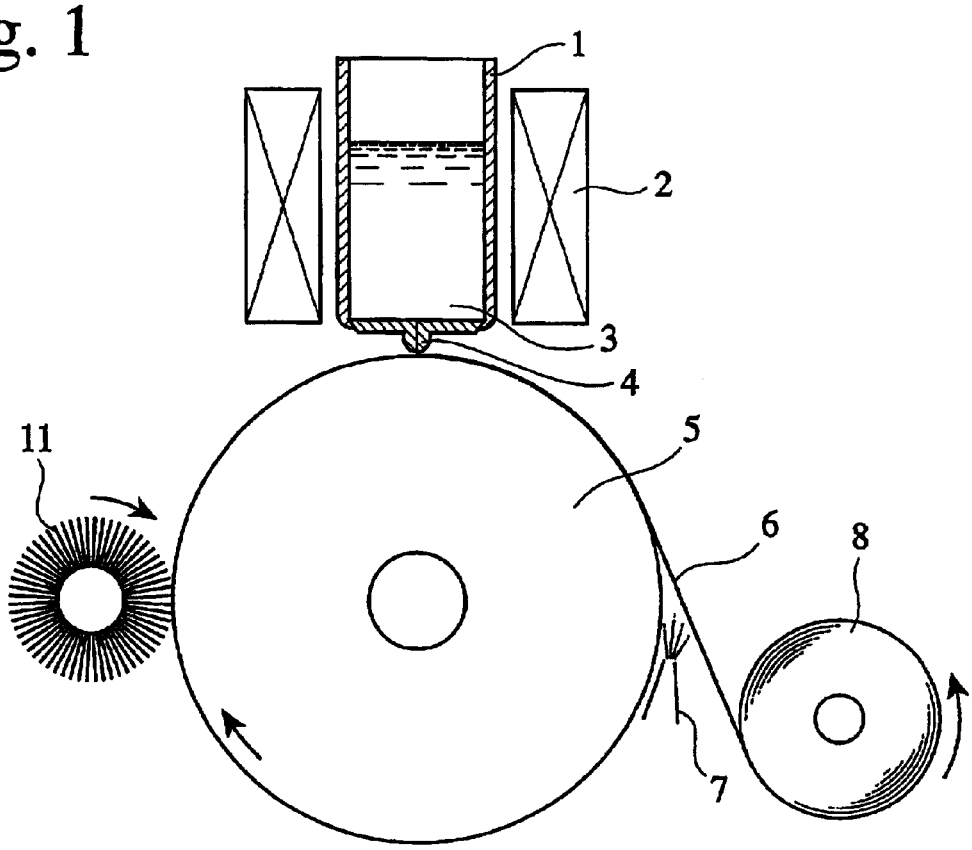
FIG. 1 is a schematic view showing one example of an apparatus for carrying out the method of the present invention for producing an amorphous alloy ribbon.

[1] Supply of $CO_2$ Gas and the Grinding of the Cooling Roll

An important feature of the present invention is that the grinding of the cooling roll is carried out while supplying a gas based on $CO_2$, in the production process of an amorphous alloy ribbon for a long period of time. The gas based on $CO_2$ is a pure $CO_2$ gas or a mixture of a $CO_2$ gas and another gas, and another gas should not exert adverse effects on the resultant amorphous alloy ribbon.

As a result of investigation of the problems inherent in the casting of an amorphous alloy ribbon in the presence of a $CO_2$ gas for a long period of time, it has been found that the influence of the deterioration of the surface roughness of a cooling roll on the ability of the cooling roll to cool a melt is extremely larger when a $CO_2$ gas is supplied during the casting than when no $CO_2$ gas is supplied, and that the deterioration of the surface roughness of the cooling roll also affects the shape of resultant ribbon in its edge portions. The deterioration of the surface roughness of the cooling roll is caused by the formation of dents by incessant impingement by a high-temperature melt, the adhesion of an alloy to the surface of the cooling roll, etc.

Further, to investigate the surface roughness of a cooling roll necessary for avoiding the above problems, comparison has been carried out on the surface roughness of cooling rolls according to JIS B 0601. As a result, it has been found that good amorphous alloy ribbons are obtained, when the cooling roll is ground such that it has an average surface roughness Ra of 0.5 $\mu$m or less and a ten-point average surface roughness Rz of 4 $\mu$m or less during the casting. It has also been found that better ribbons are obtained by having the cooling roll keep an average surface roughness Ra of 0.3 $\mu$m or less and a ten-point average surface roughness Rz of 2 $\mu$m or less.

Investigation and consideration will be given in detail below with respect to the influence of the supply of a $CO_2$ gas and the grinding of the cooling roll on the edge shape, embrittlement and crystallization of the resultant amorphous alloy ribbon, and the reasons why the grinding of the cooling roll should be carried out while supplying a $CO_2$ gas.

(1) Embrittlement and Crystallization of Ribbon

When an amorphous alloy ribbon is produced by a mass-production-scale apparatus for a long period of time while supplying a $CO_2$ gas without grinding the cooling roll, the cast amorphous alloy ribbon tends to suffer from extreme embrittlement and crystallization. On the other hand, when a $CO_2$ gas is supplied while grinding the cooling roll, substantially no embrittlement and crystallization take place in the amorphous alloy ribbon even after a long period of casting by a mass-production-scale apparatus.

(2) Shape of Ribbon Edge

When the amorphous alloy ribbon is cast by a mass-production-scale apparatus for a long period of time while supplying a $CO_2$ gas without grinding the cooling roll, extreme irregularity such as serration occurs in the shape of ribbon edges as the casting process proceeds. The serrated shape in the edge portions of the cast amorphous alloy ribbon becomes increasingly remarkable as the casting time passes. On the other hand, when a $CO_2$ gas is supplied with the cooling roll ground, substantially no irregular shapes are formed in ribbon edges even in the long casting process. Thus, the problems caused by the supply of a $CO_2$ gas can be overcome by grinding the cooling roll during the casting of a ribbon.

The first reason why the air pockets of an alloy melt decrease by a $CO_2$ gas is the thermal decomposition of the $CO_2$ gas. When the $CO_2$ gas is brought into contact with an alloy melt in the shape of a ribbon ejected from a nozzle, $CO_2$ is thermal decomposed by the heat of the alloy melt to generate CO and $O_2$, thereby forming a uniform oxide layer on the paddle surface. As a result, the viscosity of the paddle increases, thereby suppressing the vibration of the paddle. This in turn makes it difficult to entrain a $CO_2$ gas in the paddle, resulting in decrease in air pockets.

The second reason is that a $CO_2$ gas has larger specific heat than the air, nitrogen, etc. With the cooling roll subjected to contact and friction with a high-temperature melt, the cooling roll surface is roughened, and a gas highly tends to be entrained into a paddle by the rotation of the cooling roll. In such a case, air pockets are unlikely to be formed in the presence of a $CO_2$ gas, because a $CO_2$ gas having a large specific heat is not so much thermally expanded in the paddle as other gases.

Though a $CO_2$ gas had the above advantage, it is more heated by radiant heat from the paddle than the air and nitrogen, because it has large heat absorption than the air and nitrogen. Therefore, the $CO_2$ gas entrained into a boundary between the paddle and the cooling roll is at a higher temperature than the air and nitrogen. With a high-temperature $CO_2$ gas entrained into the above boundary, it is presumed that the cooling speed of the ribbon on the cooling roll is lowered, making it more likely to cause embrittlement and crystallization in the ribbon.

With dents on the cooling roll surface, the gas is likelier to be entrained in the paddle, and particularly in the case of using a $CO_2$ gas having large heat absorption, the formation of dents on the cooling roll directly leads to increase in the embrittlement and crystallization of the ribbon. Therefore, the suppression of the formation of dents on the cooling roll surface is important to reduce air pockets by a $CO_2$ gas in the long casting process of an amorphous alloy ribbon, and to suppress the embrittlement and crystallization of the amorphous alloy ribbon that start to occur after the surface temperature of the cooling roll has become substantially constant.

It is generally known that the kinetic pressure of a gas is proportional to the square of the specific gravity of a gas. When a $CO_2$ gas having a larger specific gravity than the air, nitrogen, etc. impinges on a paddle, the momentum of the $CO_2$ gas to the paddle 10 is extremely larger than that of the air, etc. Taking a nitrogen gas having a specific gravity of 1.1 and a $CO_2$ gas having a specific gravity of 1.8 at 300 K for instance, the kinetic pressure of the $CO_2$ gas is about 2.7 times that of nitrogen at the same flow rate at 300 K.

Figure 2:
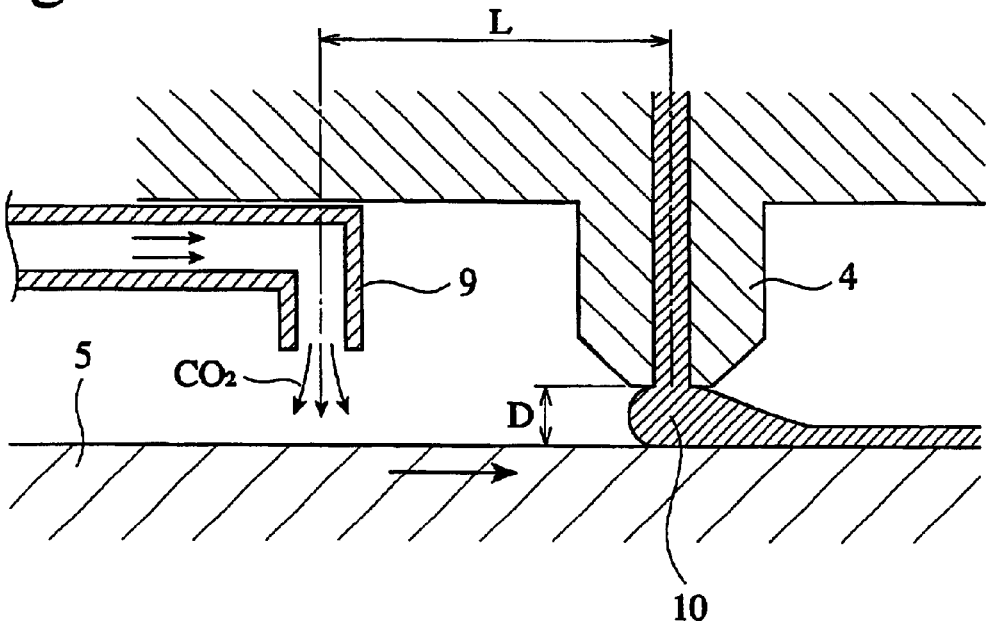
FIG. 2 is a partial cross-sectional view showing one example of a $CO_2$ gas-blowing nozzle in the apparatus of FIG. 1.

When there are few dents on the surface of a cooling roll 5 with little entrainment of a gas into the paddle 10, no problem is caused by a large momentum given by the $CO_2$ gas in FIG. 2. However, in a state where a large number of dents are formed on the cooling roll 5, a large amount of a $CO_2$ gas is entrained into the paddle 10. In this case, it is presumed that the paddle 10 is likely to be vibrated because of a large momentum of a $CO_2$ gas, resulting in irregularities such as serration in the shape of edge portions of the resultant amorphous alloy ribbon. Accordingly, to suppress irregularities such as serration in the shape of edge portions of the ribbon that occurs when using a $CO_2$ gas, it is important to suppress dents of the cooling roll 5, which increase as the casting time passes.

Because the cooling roll 5 without deteriorated surface roughness is free from the above problems, the grinding of the cooling roll 5 may start at any time during the casting process. Also, though the grinding may be carried out intermittently with a certain interval, it is preferably carried out continuously from the aspect of easiness of control.

Though the grinding of the cooling roll may be conducted with grinding papers, it is preferably carried out with a brush that does not generate dust, because the insufficient collection of dust generated by grinding causes such problem that pores, etc. are formed in the ribbon. As shown in FIG. 2, it is preferable to use as a brush 11 a roll-shaped wire brush rotating in the same direction as the cooling roll 5. The rotation speed of the brush 11 is preferably ⅓ or less, particularly 1/10–⅕, of the peripheral speed of the cooling roll 5.

When the brush 11 used for grinding is too hard, the surface of the cooling roll 5 is deeply scratched by grinding, resulting in such problems as the breakage of the ribbon 6 during the casting and decrease in the improvement of surface roughness of the cooling roll 5. Accordingly, the brush 11 for grinding preferably has the same hardness or less as that of the cooling roll 5. Such brush 11 is preferably constituted by thin wires of stainless steel, brass, copper, etc. Each wire for the brush 11 preferably has a diameter of 0.03–0.1 mm.

The materials of the cooling roll 5 are preferably alloys having high thermal conductivity, such as Cu, Cu—Be alloys, Cu–Cr alloys, etc. Also, when a cooling medium such as water, etc. is caused to flow in the cooling roll 5 in a circumferential or axial direction, the control of the surface temperature of the cooling roll 5 becomes easier.

[2] Amorphous Alloy Ribbon (1) Alloy Composition

The alloy to which the method of the present invention is applicable contains B from the aspect of capability of forming an amorphous structure. However, an excessively large content of B not only leads to the embrittlement and decrease in a magnetic flux density of an amorphous alloy ribbon, but also causes the problem of a higher cost because B is an expensive element. Accordingly, the content of B is preferably 13 atomic % or less. The more preferred content of B 4–13 atomic %.

Particularly in the case of an Fe-based amorphous alloy for forming a nano-crystalline alloy, the content of B is preferably 10 atomic % or less, more preferably 4–10 atomic %. With the content of B of 10 atomic % or less, magnetically hard compounds such as $Fe_3B$ and $Fe_2B$ that hinder the movement of magnetic domain walls are difficult to be precipitated because of a nano-crystalline structure in the heat treatment, thereby making it likely to obtain a uniform nano-crystalline structure based on a bcc-Fe solid solution.

The transition elements of Groups 4A, 5A and 6A are effective for the adjustment of magnetostriction and the improvement of permeability of an amorphous alloy. The preferred transition elements in Groups 4A, 5A and 6A are Ti, Zr, Hf, V, Nb, Ta, Cr, Mo and W. These elements are concentrated in an amorphous phase remaining around bcc-Fe crystal grains formed in the heat treatment of an amorphous alloy ribbon at a temperature equal to or higher than the crystallization temperature of the alloy, thereby stabilizing the remaining amorphous phase and thus suppressing the growth of bcc-Fe crystal grains.

The amount of at least one of these transition elements added is preferably 15 atomic % or less. When the amount of the transition element added exceeds 15 atomic %, embrittlement and decrease in a magnetic flux density are likely to occur in the amorphous alloy ribbon. Though the effect of suppressing the formation of bcc-Fe crystal grains differs depending on elements, the preferred content of the transition element is 1–10 atomic %.

When at least one of Cu, Ag and Au is added to the amorphous alloy ribbon together with at least one of elements of Groups 4A, 5A and 6A, the number of primary crystal nuclei precipitated increases in the heat treatment at a temperature equal to or higher than the crystallization temperature of the alloy, thereby making the precipitated crystal grains finer. The amount of at least one of Cu, Ag and Au added is preferably 3 atomic % or less. When the amount of this element added exceeds 3 atomic %, the resultant amorphous alloy ribbon becomes brittle. Because Cu, Ag and Au are elements that are easily separated from Fe, they would be separated from Fe even with a liquid-quenching method, failing to obtain a uniform solid solution, if their contents are excessive. Incidentally, the lower limits of the amounts of Cu, Ag and Au added are preferably 0.1 atomic % for each.

(2) Production Method

The method of the present invention for producing an amorphous alloy ribbon is characterized by carrying out the grinding of the cooling roll while supplying a gas based on $CO_2$ near a paddle of an alloy melt ejected onto the cooling roll.

When the gas based on $CO_2$ is supplied to a paddle 10 in FIG. 2, there is a large likelihood that the amorphous alloy ribbon 6 is broken at the initial stage of casting. As a result of investigation of a ribbon 6 broken at the very initial stage of casting with a $CO_2$ gas supplied since before the start of casting, it has been found that the breakage of the ribbon 6 occurs while the ribbon 6 is still on the cooling roll 5, and that no cracking and breakage occur in the edge portions of the ribbon 6 after winding.

Because the surface temperature of a cooling roll is unstable several seconds to ten and several seconds after the start of casting, regardless of whether or not a $CO_2$ gas is supplied to improve the surface conditions of the ribbon 6, the paddle 10 does not have a stable shape. Accordingly, the ribbon 6 obtained immediately after the start of casting tends to be relatively thin and weak and have a large number of pores, etc., whereby it is easily broken.

Because the supply of a gas based on $CO_2$ to a paddle 10 immediately after the start of casting leads to decrease in air pockets generated in the ribbon 6 on a side in contact with the cooling roll 5, a melt and a solidified ribbon 6 are in direct contact with the cooling roll 5 in a larger area, resulting in a higher cooling speed of the ribbon 6. As a result, the solidified ribbon 6 is subjected to rapid thermal shrinkage, undergoing higher internal stress than when a gas based on $CO_2$ is not supplied. This seems to be why cracking and breakage are observed in edge portions of the ribbon 6 after winding. It is thus presumed that high stress in the ribbon 6 results in higher likelihood of breakage.

For the reasons described above, to prevent the ribbon 6 from being broken at the initial stage of casting, it is effective to start supplying a gas based on $CO_2$ near a paddle of the alloy melt, after the surface temperature of the cooling roll 5 becomes constant and the state of the ribbon 6 is stabilized.

The peripheral speed of the cooling roll 5 is preferably 35 m/second or less. With the peripheral speed of the cooling roll 5 set at 35 m/second or less, the ribbon 6 can be provided with improved surface conditions and shape in its edge portions. Particularly the shape of the ribbon 6 in edge portions can remarkably be improved. Though thinner ribbons are usually cast at higher roll peripheral speed than thicker ribbons, the peripheral speed of the cooling roll 5 is preferably as low as possible even for thin ribbons from the aspect of easiness of control. In this sense, the peripheral speed of the cooling roll 5 is more preferably 20–30 m/second, particularly preferably 27–30 m/second.

The temperature of a melt is preferably from the melting point of its alloy +50° C. to the melting point of its alloy +250° C. When the temperature of a melt is lower than the melting point of its alloy +50° C., the nozzle 4 tends to be clogged. On the other hand, when the temperature of the melt is higher than the melting point of its alloy +250° C., the cooling speed of the melt is slow near the solidification temperature of the melt, resulting in the brittleness and crystallization of alloy ribbons. The high melt temperature also provides the resultant alloy ribbons with rough surface because of large wear of the cooling roll 5. The more preferred temperature of the melt is from the melting point of its alloy +100° C. to the melting point of its alloy +200° C.

The distance D between the tip end of the melt-ejecting nozzle 4 and the cooling roll 5 is preferably 200 μm or less. When a thin ribbon is produced at a low peripheral speed, it is preferable to reduce the size of a slit of the melt-ejecting nozzle 4 or the distance D between the melt-ejecting nozzle 4 and the cooling roll 5. The more preferred distance D is 100–180 μm, particularly 100–150 μm.

As shown in FIG. 2, the position of a nozzle 9 blowing a gas based on $CO_2$ is preferably on the upstream side of the melt-ejecting nozzle 4. Here, "on the upstream side of a nozzle 4" means a front side in a direction of the relative movement of the nozzle 4 to the cooling roll 5. The ejection direction of a $CO_2$ gas, which is identical to the direction of the nozzle 9, is preferably the radial direction of the cooling roll 5.

Also, the ejection direction of a gas based on $CO_2$ is preferably set substantially upstream of the paddle. With the ejection of a gas based on $CO_2$ directed to the cooling roll 5 substantially upstream of the paddle 10, the conditions of the ribbon 6 on a freely solidified surface are improved, and the formation of air pockets are more remarkably suppressed, than when the gas is directly supplied to the tip end of the nozzle 4 or to the paddle 10.

(3) Amorphous Alloy Ribbon

In the amorphous alloy ribbon produced under the above conditions, substantially no α-Fe crystal phase is precipitated. Crystals precipitated in the amorphous alloy ribbon because of improper casting conditions are those in the form of dendrite as large as 0.2–1 μm in particle size not nano-crystalline, which are much larger than fine crystals precipitated from the amorphous phase by the heat treatment. The existence of such large crystals makes the nano-crystalline structure obtained by the heat treatment non-uniform, resulting in larger crystal magnetic anisotropy and thus deteriorated magnetic properties of the nano-crystalline alloy ribbon.

The method of the present invention can generally provide an amorphous alloy ribbon having a thickness in a range of 8–25 μm. Particularly even at a thickness of 19 μm or less, the amorphous alloy ribbon obtained by the present invention has excellent surface conditions and shape in edge portions. In addition, the method of the present invention is suitable for stably producing an amorphous alloy ribbon having a length of about 3,000 m or more and excellent surface conditions and shape in edge portions.

[3] Nano-Crystalline Alloy Ribbon

The amorphous alloy ribbon 6 with low crystallinity obtained by the method of the present invention can be converted to a nano-crystalline alloy ribbon by a heat treatment. Here, "nano-crystalline" means a metal structure containing fine crystals having an average particle size of 100 nm or less.

As described above, to obtain a nano-crystalline alloy ribbon with excellent magnetic properties, it is important that the amorphous alloy ribbon 6 to be heat-treated should not contain coarse crystals. This is because the slightest amount of course crystals in the amorphous alloy ribbon 6 to be heat-treated causes extreme deterioration in magnetic properties in a nano-crystalline alloy ribbon obtained by a heat treatment at a crystallization temperature or higher.

The heat treatment for obtaining a nano-crystalline alloy ribbon comprises heating at 400–700° C. for 1 minute to 24 hours. When the heat treatment temperature is lower than 400° C., fine crystallization cannot substantially be achieved. On the other hand, when it exceeds 700° C., coarse crystal grains are likely to be precipitated. The preferred heat treatment temperature is 500–650° C. Though the heat treatment time may vary depending on the heat treatment temperature, the heat treatment time of less than 1 minute generally fails to achieve the stable precipitation of fine crystals. On the other hand, when it exceeds 24 hours, only low production efficiency of forming a nano-crystalline alloy ribbon can be achieved. Incidentally, because the heat treatment of the amorphous alloy ribbon in the air oxidizes a ribbon surface, resulting in deterioration in the magnetic properties of the resultant nano-crystalline alloy ribbon, the heat treatment is preferably carried out in an inert atmosphere such as nitrogen, argon, etc.

The present invention will be described in detail referring to EXAMPLES below without intention of limiting the present invention thereto.

EXAMPLES 1 and 2, COMPARATIVE EXAMPLES 1–4

Production and Evaluation of Amorphous Alloy Ribbon

An ingot of an Fe-based alloy having a composition of $Cu_1Nb_{2.5}Si_{13.5}B_7Fe_{bal.}$ by atomic % was introduced into a crucible 1 shown in FIG. 1, and melted by induction heating by a high-frequency coil 2. The resultant alloy melt 3 was ejected onto a cooling roll 5 made of a Cu—Be alloy and rapidly quenched under the conditions shown in Table 1 below, to form an amorphous alloy ribbon 6 of EXAMPLE 1 having a width of 30 mm and a thickness of 19 μm.

TABLE 1

| Casting Conditions | |
|---|---|
| Temperature of melt 3 | 1,350° C. |
| Peripheral speed of cooling roll 5 | 27 m/second |
| Distance D between tip end of melt-ejecting nozzle 4 and cooling roll 5 | 120 μm |
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 30 L/minute |
| Start of supplying $CO_2$ gas | After 5 seconds from start of casting |
| Grinding of cooling roll 5 | Grinding at peripheral speed of 5 m/second from immediately after start of casting to end of casting with 0.06-mm-diameter brass wire brush |
| Distance L between paddle 10 and orifice of $CO_2$ gas-blowing nozzle 9 | 15 mm |
| Shape of orifice of $CO_2$ gas-blowing nozzle 9 | 40 mm in width direction of cooling roll 5 and 1 mm in rotation direction of cooling roll 5 |

As shown in FIG. 1, the resultant amorphous alloy ribbon 6 was caused to peel off from the cooling roll 5 by supplying a nitrogen gas from a nozzle 7 onto the cooling roll 5 in an opposite direction to the rotation direction of the cooling roll 5, and a reel 8 having a permanent magnet embedded therein and rotating in an opposite direction to the rotation direction of the cooling roll 5 was brought close to the cooling roll 5 to wind the amorphous alloy ribbon 6. The winding of the amorphous alloy ribbon 6 onto the reel 8 was started after about 2 seconds from the start of casting.

Portions of the resultant amorphous alloy ribbon were taken as samples when 1 minute passed from the start of casting, and when 10 minutes passed from the start of casting, respectively. The samples of EXAMPLE 1 and COMPARATIVE EXAMPLES 1 and 2 were ribbon portions obtained when 1 minute passed from the start of casting, and the samples of EXAMPLE 2 and COMPARATIVE EXAMPLES 3 and 4 were ribbon portions obtained when 10 minutes passed from the start of casting.

Incidentally, the grinding of the cooling roll 5 was carried out, while supplying a $CO_2$ gas and rotating a brush 11 in the same direction as the cooling roll 5 in the production process of the ribbon 6 of EXAMPLES 1 and 2. The grinding of the cooling roll 5 was not carried out in the production process of the ribbon 6 of COMPARATIVE EXAMPLES 1 and 3, though a $CO_2$ gas was supplied. The supply of a $CO_2$ gas and the grinding of the cooling roll 5 were not carried out in the production process of the ribbon 6 of COMPARATIVE EXAMPLES 2 and 4.

With respect to each of the resultant ribbons, an average surface roughness Ra on both of the freely solidified surface and the surface in contact with the cooling roll 5, the presence of crystals and embrittlement were examined. The average surface roughness Ra was measured according to JIS B 0601. The presence of crystals was evaluated by the intensity of a peak of α-Fe (200) in the X-ray diffraction pattern of each ribbon. The presence of embrittlement was evaluated by cracking caused by a 180° bending test according to JIS Z 2248. In addition to the above items, a reflection electron image of an edge portion of each ribbon was taken using a scanning electron micrograph to evaluate the serrated irregularities of the edge portion.

The evaluation results of the amorphous alloy ribbons of EXAMPLE 1 and COMPARATIVE EXAMPLES 1 and 2 are shown in Tables 2 and 3. As is clear from Table 2, when 1 minute passed from the start of casting, the ribbons of EXAMPLE 1 and COMPARATIVE EXAMPLE 1 produced while supplying a $CO_2$ gas had substantially the same surface roughness, which was smaller than that of the ribbon of COMPARATIVE EXAMPLE 2 produced without supplying a $CO_2$ gas, regardless of whether or not the grinding of the cooling roll 5 was carried out. With respect to embrittlement, crystallization and edge shape, there were no appreciable differences between the ribbon of EXAMPLE 1 and those of COMPARATIVE EXAMPLES 1 and 2.

As is clear from Table 3, when 10 minutes passed from the start of casting, too, the ribbons 6 of EXAMPLE 2 and COMPARATIVE EXAMPLE 3 produced while supplying a $CO_2$ gas, regardless of whether or not the grinding of the cooling roll 5 was carried out, had substantially the same surface roughness, which was extremely smaller than that of the ribbon of COMPARATIVE EXAMPLE 4. However, it was confirmed that the ribbon 6 of COMPARATIVE EXAMPLE 3 produced only by supplying a $CO_2$ gas without grinding the cooling roll 5 was poorer than the ribbon of EXAMPLE 2 in crystallization, embrittlement and edge shape. On the other hand, the ribbon 6 of EXAMPLE 2 produced by carrying out the grinding of the cooling roll 5 during the casting was clearly improved in crystallization, embrittlement and edge shape.

Figure 3:
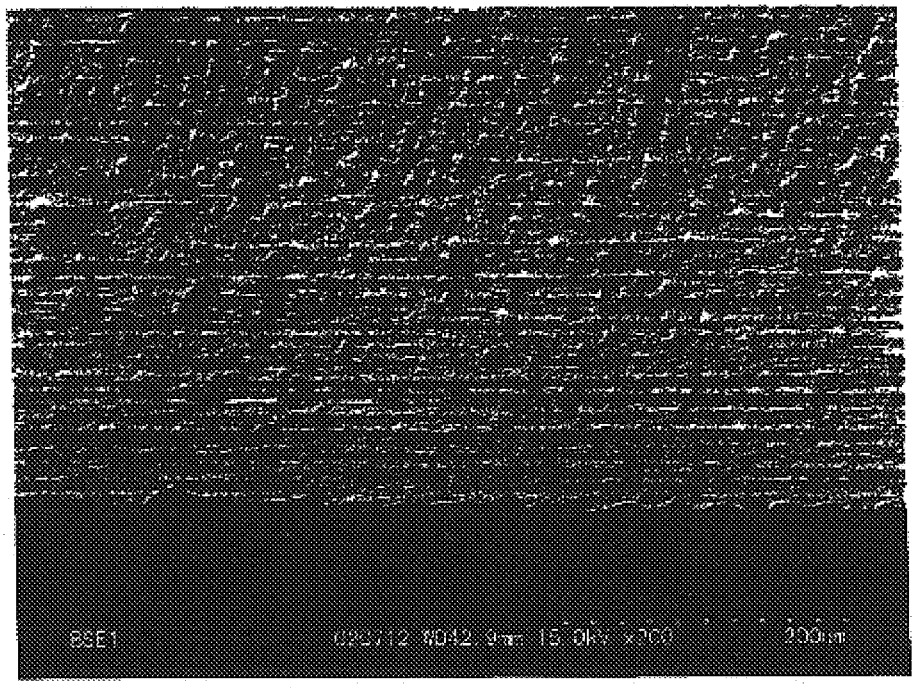
FIG. 3 is an electron photomicrograph showing an edge portion of the amorphous alloy ribbon of EXAMPLE 2.
Figure 4:
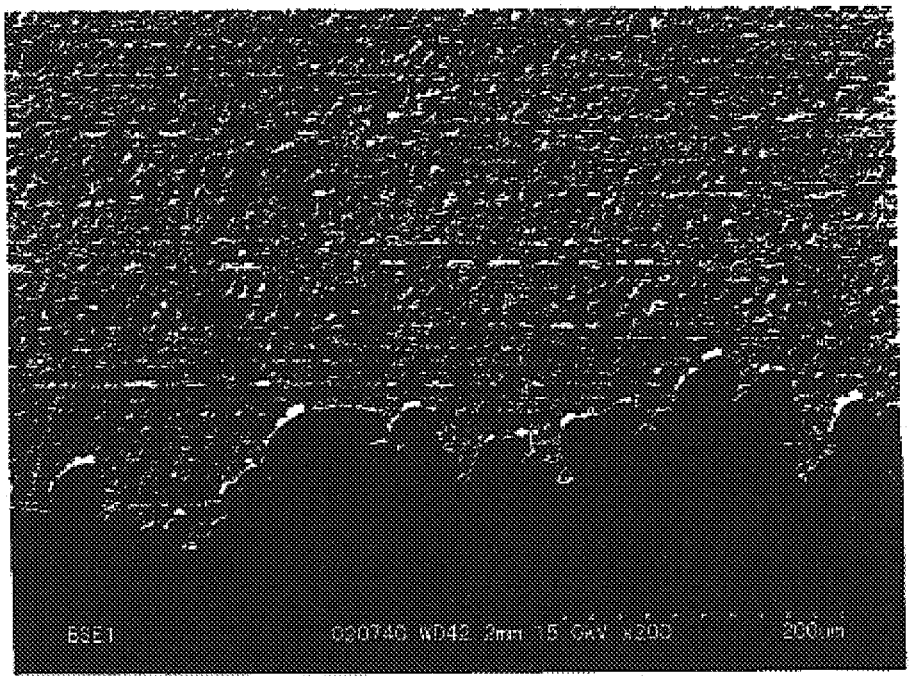
FIG. 4 is an electron photomicrograph showing an edge portion of the amorphous alloy ribbon of COMPARATIVE EXAMPLE 3.
Figure 5:
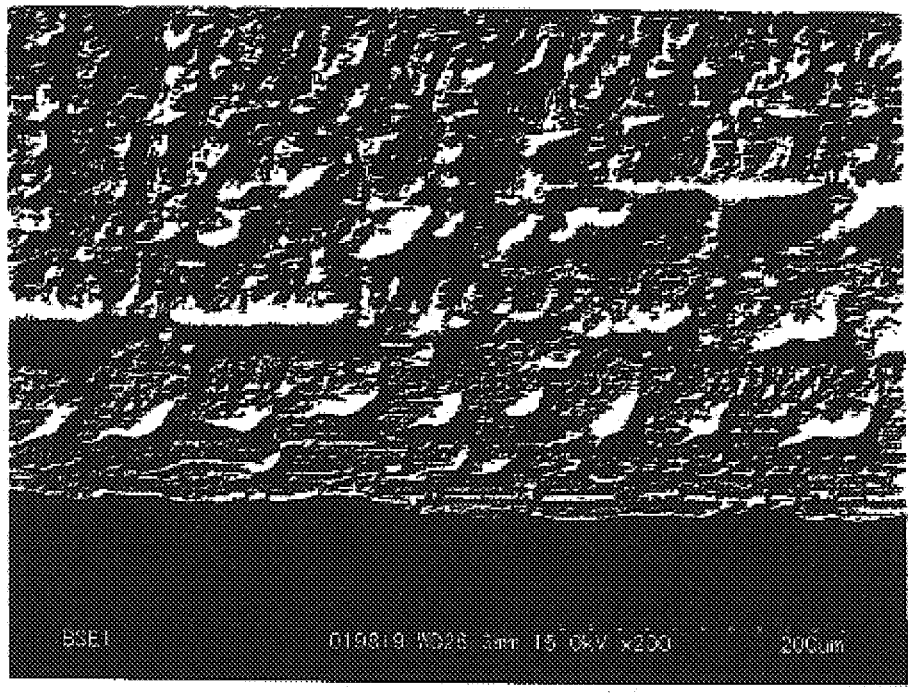
FIG. 5 is an electron photomicrograph showing an edge portion of the amorphous alloy ribbon of COMPARATIVE EXAMPLE 4.

The electron photomicrographs of the amorphous alloy ribbons 6 of EXAMPLE 2 and COMPARATIVE EXAMPLES 3 and 4 in their edge portions are shown in FIGS. 3, 4 and 5. As is clear from FIGS. 3 and 4, the ribbon of EXAMPLE 2 produced while supplying a $CO_2$ gas and grinding the cooling roll 5 was flatter in a shape in edge portions than the ribbon of COMPARATIVE EXAMPLE 3 produced while supplying a $CO_2$ gas without grinding the cooling roll 5. Also, as is clear from FIG. 5, the ribbon of COMPARATIVE EXAMPLE 4 produced without supplying a $CO_2$ gas was rife with air pockets, though it had a flat edge shape.

Production and Evaluation of Nano-Crystalline Alloy Ribbon

Using the same amorphous alloy ribbon portions as above, wound cores each having an outer diameter 20 mm and an inner diameter of 15 mm were produced, and then heat-treated at 550° C. for 60 minutes to form wound cores of nano-crystalline alloy ribbons. Each of the resultant nano-crystalline alloy ribbons was measured with respect to an initial permeability at a frequency of 1 kHz. The results are shown in Tables 2 and 3. As is clear from Tables 2 and 3, a nano-crystalline alloy ribbon having excellent soft magnetic properties could be produced stably for a long period of time from an amorphous alloy ribbon 6 cast while supplying a $CO_2$ gas and grinding the cooling roll 5.

The observation of the metal structure of the nano-crystalline alloy ribbon with a transmission electron micrograph revealed that in a case where nano-crystalline alloy ribbons were obtained from the amorphous alloy ribbon portion of EXAMPLE 1 obtained when 1 minute passed from the start of casting and the amorphous alloy ribbon portion of EXAMPLE 2 obtained when 10 minutes passed, respectively, both of them had an average particle size of about 20 nm. The nano-crystalline alloy ribbons of COMPARATIVE EXAMPLES 1 and 2 also had an average particle size of about 20 nm, as long as they were obtained from the amorphous alloy ribbon portions obtained when 1 minute passed from the start of casting. However, crystal particles exceeding a particle size of 0.1 μm were observed in the nano-crystalline alloy ribbons of COMPARATIVE EXAMPLES 3 and 4 obtained from the amorphous alloy ribbon portions obtained when 10 minutes passed from the start of casting.

TABLE 2

| | When 1 minute passed from the start of casting | | | | | | | | |
|---|---|---|---|---|---|---|---|---|---|
| | Production Conditions | | Average Surface Roughness Ra (μm) | | Intensity of α (200) Peak (cps) | | | | |
| No. | Supply of $CO_2$ Gas | Grinding of Roll | Freely Solidified Surface | Surface in Contact with Roll | Freely Solidified Surface | Surface in Contact with Roll | Shape in Edge Portion | Cracking by Bending Test | Initial Permeability after Heat Treatment |
| EXAMPLE 1 | Yes | Yes | 0.27 | 0.23 | 0 | 0 | ○ | No | 162,700 |
| COM. EX. 1 | Yes | No | 0.28 | 0.22 | 0 | 0 | ○ | No | 162,400 |
| COM. EX. 2 | No | No | 0.38 | 0.40 | 0 | 0 | ○ | No | 149,300 |

TABLE 3

| | When 10 minutes passed from the start of casting | | | | | | | | |
|---|---|---|---|---|---|---|---|---|---|
| | Production Conditions | | Average Surface Roughness Ra ($\mu$m) | | Intensity of $\alpha$ (200) Peak (cps) | | | | |
| No. | Supply of $CO_2$ Gas | Grinding of Roll | Freely Solidified Surface | Surface in Contact with Roll | Freely Solidified Surface | Surface in Contact with Roll | Shape in Edge Portion | Cracking by Bending Test | Initial Permeability after Heat Treatment |
| EXAMPLE 2 | Yes | Yes | 0.34 | 0.33 | 0 | 0 | ○ | No | 135,400 |
| COM. EX. 3 | Yes | No | 0.32 | 0.29 | 430 | 3,100 | X | Yes | 58,700 |
| COM. EX. 4 | No | No | 0.81 | 0.85 | 210 | 2,130 | ○ | Yes | 75,400 |

EXAMPLES 3 and 4, COMPARATIVE EXAMPLES 5–8

An ingot of an alloy having a composition of 9 atomic % of Si W and 13 atomic % of B, the balance being substantially Fe, was introduced into a crucible 1 shown in FIG. 1 and melted by induction heating by a high-frequency coil 2. The resultant melt 3 was ejected onto the cooling roll 5 made of a Cu—Cr alloy and rapidly quenched to produce an amorphous alloy ribbon 6 having a width of 40 mm and a thickness of 20 $\mu$m under the conditions shown in Table 4.

TABLE 4

| Casting Conditions | |
|---|---|
| Temperature of melt 3 | 1,300° C. |
| Peripheral speed of cooling roll 5 | 30 m/second |
| Distance D between tip end of melt-ejecting nozzle 4 and cooling roll 5 | 180 $\mu$m |
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 40 L/minute |
| Start of supplying $CO_2$ gas | After 5 seconds from start of casting |
| Grinding of cooling roll 5 | Grinding at peripheral speed of 5 m/second from immediately after start of casting to end of casting with 0.08-mm-diameter brass wire brush |
| Distance L between paddle 10 and orifice of $CO_2$ gas-blowing nozzle 9 | 10 mm |
| Shape of orifice of $CO_2$ gas-blowing nozzle 9 | 55 mm in width direction of cooling roll 5 and 1 mm in rotation direction of cooling roll 5 |

Taken as samples were amorphous alloy ribbon portions obtained when 1 and 10 minutes, respectively, passed from the start of casting. The samples of EXAMPLE 3 and COMPARATIVE EXAMPLES 5 and 6 were ribbon portions obtained when 1 minute passed from the start of casting, and the samples of EXAMPLE 4 and COMPARATIVE EXAMPLES 7 and 8 were ribbon portions obtained when 10 minutes passed from the start of casting.

Incidentally, the grinding of the cooling roll 5 was carried out by rotating a brush 11 in the same direction as the cooling roll 5 in the production process of the ribbons 6 of EXAMPLES 3 and 4 in the presence of a $CO_2$ gas supplied. The grinding of the cooling roll 5 was not carried out in the production process of the ribbons 6 of COMPARATIVE EXAMPLES 5 and 7 in the presence of a $CO_2$ gas supplied. The grinding of the cooling roll 5 were also not carried out in the production process of the ribbons 6 of COMPARATIVE EXAMPLES 6 and 8 in the absence of a $CO_2$ gas. Each of the resultant amorphous alloy ribbons 6 started to be wound around a reel 8 after about 2 seconds from the start of casting in the same manner as in EXAMPLE 1.

Each of the amorphous alloy ribbons of EXAMPLE 3 and COMPARATIVE EXAMPLES 5 and 6 were evaluated with respect to surface roughness, a crystal phase, embrittlement and a shape in edge portions in the same manner as in EXAMPLE 1. The evaluation results are shown in Tables 5 and 6. As is clear from Table 5, regardless of whether or not the grinding of the cooling roll 5 was carried out, the amorphous alloy ribbon portions of EXAMPLE 3 and COMPARATIVE EXAMPLE 5 obtained when 1 minute passed from the start of casting with a $CO_2$ gas supplied had substantially the same surface roughness, which was smaller than the surface roughness of the ribbon of COMPARATIVE EXAMPLE 6 produced without supplying a $CO_2$ gas. With respect to embrittlement, crystallization and a shape in edge portions, there were no appreciable differences among the ribbons of EXAMPLE 3 and COMPARATIVE EXAMPLES 5 and 6.

As shown in Table 6, among the amorphous alloy ribbon portions obtained when 10 minutes passed from the start of casting, the ribbon portions of EXAMPLE 4 and COMPARATIVE EXAMPLE 7 produced while supplying a $CO_2$ gas had smaller surface roughness than the ribbon portions of COMPARATIVE EXAMPLE 8 produced without supplying a $CO_2$ gas, regardless of whether or not the grinding of the cooling roll 5 was carried out. With respect to crystallization and embrittlement, there were no appreciable differences among the ribbons of EXAMPLE 4 and COMPARATIVE EXAMPLES 7 and 8. This seems to be because the alloys used in EXAMPLE 4 and COMPARATIVE EXAMPLES 7 and 8 had higher capability of forming an amorphous structure than the alloy used in EXAMPLE 1

Figure 6:
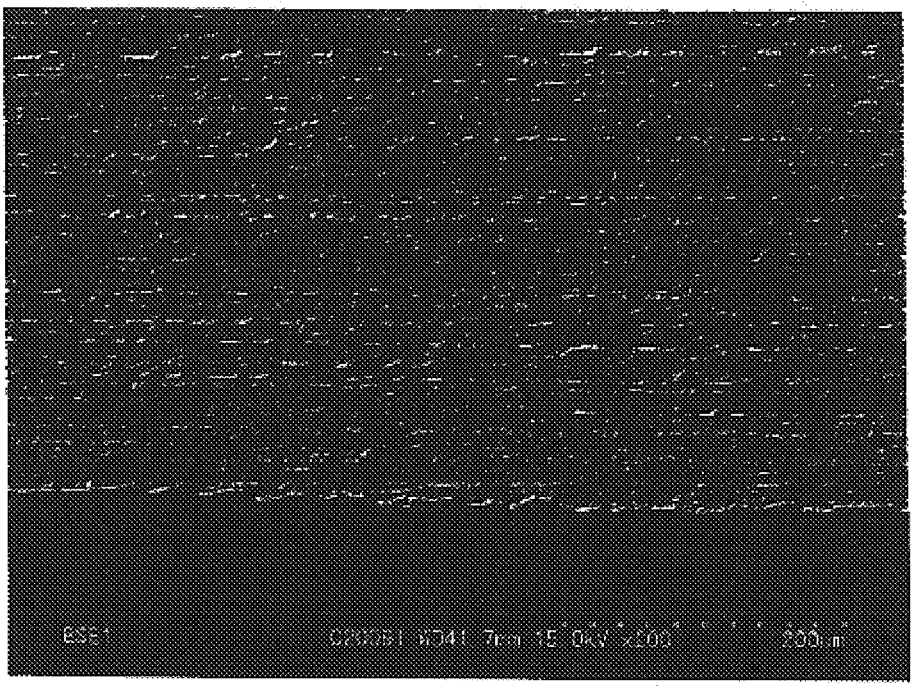
FIG. 6 is an electron photomicrograph showing an edge portion of the amorphous alloy ribbon of EXAMPLE 4.
Figure 7:
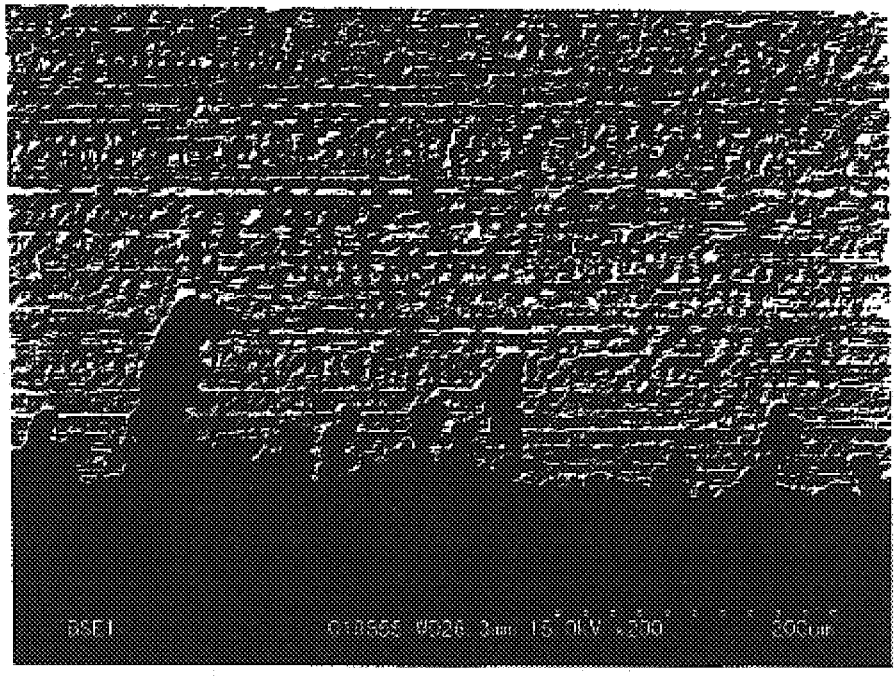
FIG. 7 is an electron photomicrograph showing an edge portion of the amorphous alloy ribbon of COMPARATIVE EXAMPLE 7.

However, the ribbon of COMPARATIVE EXAMPLE 7 produced while supplying a $CO_2$ gas without grinding the cooling roll 5 had a poor shape in its edge portions. FIGS. 6 and 7 are electron photomicrographs showing the ribbon shapes of EXAMPLE 4 and COMPARATIVE EXAMPLE 7 in their edge portions. It was found from FIGS. 6 and 7 that the ribbon of EXAMPLE 4 had an improved shape in edge portions than the ribbon of COMPARATIVE EXAMPLE 7.

TABLE 5

| When 1 minute passed from the start of casting | | | | | | | | |
|---|---|---|---|---|---|---|---|---|
| | Production Conditions | | Average Surface Roughness Ra (μm) | | Intensity of α (200) Peak (cps) | | | |
| No. | Supply of $CO_2$ Gas | Grinding of Roll | Freely Solidified Surface | Surface in Contact with Roll | Freely Solidified Surface | Surface in Contact with Roll | Shape in Edge Portion | Cracking by Bending Test |
| EXAMPLE 3 | Yes | Yes | 0.26 | 0.22 | 0 | 0 | ○ | No |
| COM. EX. 5 | Yes | No | 0.25 | 0.21 | 0 | 0 | ○ | No |
| COM. EX. 6 | No | No | 0.36 | 0.31 | 0 | 0 | ○ | No |

TABLE 6

| When 10 minutes passed from the start of casting | | | | | | | | |
|---|---|---|---|---|---|---|---|---|
| | Productions Conditions | | Average Surface Roughness Ra (μm) | | Intensity of α (200) Peak (cps) | | | |
| No. | Supply of $CO_2$ Gas | Grinding of Roll | Freely Solidified Surface | Surface in Contact with Roll | Freely Solidified Surface | Surface in Contact with Roll | Shape in Edge Portion | Cracking by Bending Testhz,1/48 |
| EXAMPLE 4 | Yes | Yes | 0.31 | 0.30 | 0 | 0 | ○ | No |
| COM. EX. 7 | Yes | No | 0.30 | 0.32 | 0 | 0 | X | No |
| COM. EX. 8 | No | No | 0.61 | 0.65 | 0 | 0 | ○ | No |

EXAMPLES 5–7

Each ingot of alloys having compositions shown in Table 8 was introduced into a crucible 1 shown in FIG. 1, and melted by induction heating by a high-frequency coil 2. Each of the resultant alloy melts 3 was ejected onto a cooling roll 5 made of a Cu—Be alloy and rapidly quenched to produce an amorphous alloy ribbon 6 having a width of 30 mm and a thickness of 22 μm under the conditions shown in Table 7. The casting of the amorphous alloy ribbon was repeated 10 times. In the production process of the ribbon with a $CO_2$ gas supplied, the grinding of the cooling roll 5 was carried out by rotating a brush 11 in the same direction as the cooling roll 5. The winding method of the resultant ribbon was the same as in EXAMPLE 1.

TABLE 7

| Casting Conditions | |
|---|---|
| Temperature of melt 3 | 1,350° C. |
| Peripheral speed of cooling roll 5 | 27 m/second |
| Distance D between tip end of melt-ejecting nozzle 4 and cooling roll 5 | 120 μm |
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 30 L/minute |
| Start of supplying $CO_2$ gas | After 5 seconds from start of casting |
| Grinding of cooling roll 5 | Grinding at peripheral speed of 5 m/second from immediately after start of casting to end of casting with 0.06-mm-diameter stainless steel wire brush |

TABLE 7-continued

| Casting Conditions | |
|---|---|
| Distance L between paddle 10 and orifice of $CO_2$ gas-blowing nozzle 9 | 15 mm |
| Shape of orifice of $CO_2$ gas-blowing nozzle 9 | 40 mm in width direction of cooling roll 5 and 1 mm in rotation direction of cooling roll 5 |

Each of the resultant ribbons was measured with respect to an average surface roughness Ra according to JIS B 0601 both on a freely solidified surface and on a side in contact with the cooling roll 5. Also, a 180° bending test was carried out according to JIS Z 2248 to evaluate the percentage of cracking in each sample. The percentage of cracking was determined on 10 samples for each composition as a ratio of samples with cracking to all samples, each sample being a ribbon portion obtained 10 minutes after the start of casting. The results are shown in Table 8. As is clear from Table 8, the average surface roughness Ra was as small as 0.5 μm or less in any samples, though the ribbon of EXAMPLE 7 containing more than 13 atomic % of B became brittle. The observation of ribbon edge shapes by an electron micrograph revealed that no ribbons suffered serrated irregularities in their edge portions.

TABLE 8

| No. | Composition (at. %) | Average Surface Roughness Ra (μm) Freely Solidified Surface | Surface in Contact with Roll | Cracking (%) |
|---|---|---|---|---|
| EXAMPLE 5 | $Fe_{bal.}Nb_4Si_5B_9$ | 0.38 | 0.37 | 0 |
| EXAMPLE 6 | $Fe_{bal.}Nb_4Si_5B_{12}$ | 0.35 | 0.38 | 0 |
| EXAMPLE 7 | $Fe_{bal.}Nb_4Si_5B_{16}$ | 0.37 | 0.36 | 60 |

Each of the amorphous alloy ribbons of EXAMPLES 5 and 6 was heat-treated under the same conditions as in EXAMPLE 1 except for the heat treatment temperature of 600–650° C. The observation of each heat-treated ribbon by a transmission electron micrograph revealed that any of the heat-treated ribbons had a nano-crystalline structure containing fine crystals having an average particle size of 100 nm or less. It was confirmed from these results that these amorphous alloy ribbons were converted to nano-crystalline alloy ribbons by a heat treatment.

EXAMPLES 8–19

An ingot of an alloy having a composition shown in Table 10 was introduced into a crucible 1 shown in FIG. 1, and melted by induction heating by a high-frequency coil 2. Each of the resultant alloy melts 3 was ejected onto a cooling roll 5 made of a Cu—Be alloy and rapidly quenched to produce an amorphous alloy ribbon 6 having a width of 40 mm and a thickness of 20 μm under the conditions shown in Table 9 below. In the production process of the ribbon 6 with a $CO_2$ gas supplied, the grinding of the cooling roll 5 was carried out by rotating a brush 11 in the same direction as the cooling roll 5. The winding method of the resultant ribbon was the same as in EXAMPLE 1.

TABLE 9

| Casting Conditions | |
|---|---|
| Temperature of melt 3 | 1,350° C. |
| Peripheral speed of cooling roll 5 | 27 m/second |
| Distance D between tip end of melt-ejecting nozzle 4 and cooling roll 5 | 120 μm |
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 30 L/minute |
| Start of supplying $CO_2$ gas | After 5 seconds from start of casting |
| Grinding of cooling roll 5 | Grinding at peripheral speed of 5 m/second from immediately after start of casting to end of casting with 0.07-mm-diameter brass wire brush |
| Distance L between paddle 10 and orifice of $CO_2$ gas-blowing nozzle 9 | 15 mm |
| Shape of orifice of $CO_2$ gas-blowing nozzle 9 | 40 mm in width direction of cooling roll 5 and 1 mm in rotation direction of cooling roll 5 |

Using as samples amorphous alloy ribbon portions obtained when 20 minutes passed from the start of casting, the peak of an α-Fe crystal phase on a side in contact with the cooling roll 5 was evaluated by X-ray diffraction. As a result, it was confirmed that any of the amorphous alloy ribbons had no precipitated crystal phase.

Each sample of the amorphous alloy ribbons was wound around a reel 8 to form a wound core having an outer diameter of 19 mm and an inner diameter of 15 mm, which was heat-treated by keeping at 500–600° C. for 1 hour and then cooling. The observation of the heat-treated ribbons by a transmission electron micrograph revealed that any of the heat-treated ribbons had a nano-crystalline structure containing fine crystals having an average particle size of 100 nm or less. No irregular edge shapes were observed in any amorphous alloy ribbons.

Each nano-crystalline alloy ribbon was measured with respect to the maximum value of a specific initial permeability $\mu_i$ at a frequency of 1 kHz. As a result, it was found that the ribbons having compositions with the most preferred range of B in EXAMPLES 8–17 had as high a specific initial permeability $\mu_i$ as 80,500–128,000 at 1 kHz, and that the ribbons of EXAMPLES 18 and 19 containing more than 10 mol % of B had as low a specific initial permeability $\mu_i$ as 47,000 and 35,000, respectively, at 1 kHz.

TABLE 10

| No. | Composition (mol %) | Maximum Value of Specific Initial Permeability $\mu_i$ at 1 kHz |
|---|---|---|
| EXAMPLE 8 | $Fe_{bal.}Cu_{0.75}Au_{0.15}Nb_3Si_{15}B_8$ | 98,000 |
| EXAMPLE 9 | $Fe_{bal.}Cu_1Nb_3Si_{15}B_{8.5}$ | 128,000 |
| EXAMPLE 10 | $Fe_{bal}Cu_1Mo_3Si_{15}B_8$ | 108,000 |
| EXAMPLE 11 | $Fe_{bal.}Cu_1Mo_3Si_{15}B_{8.5}$ | 111,000 |
| EXAMPLE 12 | $Fe_{bal.}Cu_{0.6}Nb_{2.6}Si_{11}B_9$ | 98,500 |
| EXAMPLE 13 | $Fe_{bal.}Cu_{0.6}Nb_{2.6}Si_{12}B_9$ | 109,000 |
| EXAMPLE 14 | $Fe_{bal.}Cu_{0.9}Nb_2Mo_1Si_{14}B_9$ | 92,300 |
| EXAMPLE 15 | $Fe_{bal.}Cu_{0.9}Nb_2Mo_1Si_{14}B_{9.1}$ | 91,500 |
| EXAMPLE 16 | $Fe_{bal.}Cu_1Nb_{3.5}Zr_{3.5}B_8$ | 85,500 |
| EXAMPLE 17 | $Fe_{bal.}Cu_1Nb_{3.5}Zr_{3.5}B_{8.5}$ | 80,500 |
| EXAMPLE 18 | $Fe_{bal.}Cu_{0.75}Au_{0.1}Nb_3Si_{15}B_{12}$ | 47,000 |
| EXAMPLE 19 | $Fe_{bal.}Cu_{0.75}Au_{0.1}Nb_3Si_{15}B_{14}$ | 35,000 |

EXAMPLES 20 and 21, COMPARATIVE EXAMPLE 9

An ingot of an alloy having a composition of $Cu_1Nb_{2.5}Si_{13.5}B_7Fe_{bal.}$ by atomic % was introduced into a crucible 1 shown in FIG. 1, and melted by induction heating by a high-frequency coil 2. The resultant alloy melt 3 was ejected onto a cooling roll 5 made of a Cu—Be alloy under the conditions shown in Table 11 and rapidly quenched, to produce an amorphous alloy ribbon 6 having a width of 30 mm and a thickness of 19 μm. In the production process of the amorphous alloy ribbon 6 of EXAMPLE 20, the grinding of the cooling roll 5 was carried out by rotating a brush 11 in the same direction as the cooling roll 5 while supplying a $CO_2$ gas. The winding method of the resultant ribbon was the same as in EXAMPLE 1. The casting was repeated 10 times under the same conditions.

TABLE 11

| Casting Conditions | |
|---|---|
| Temperature of melt 3 | 1,350° C. |
| Peripheral speed of cooling roll 5 | 27 m/second |
| Distance D between tip end of melt-ejecting nozzle 4 and cooling roll 5 | 120 μm |
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 30 L/minute |
| Start of supplying $CO_2$ gas | After 5 seconds from start of casting |
| Grinding of cooling roll 5 | Grinding at peripheral speed of 5 m/second from immediately after start of casting to end of casting with 0.06-mm-diameter stainless steel wire brush |
| Distance L between paddle 10 and orifice of $CO_2$ gas-blowing nozzle 9 | 15 mm |
| Shape of orifice of $CO_2$ gas-blowing nozzle 9 | 40 mm in width direction of cooling roll 5 and 1 mm in rotation direction of cooling roll 5 |

The amorphous alloy ribbon 6 of EXAMPLE 21 was produced under the same conditions as in EXAMPLE 20 except for supplying a $CO_2$ gas at a flow rate of 30 L/minute since before the start of casting. The amorphous alloy ribbon 6 of COMPARATIVE EXAMPLE 9 was produced under the same conditions as in EXAMPLE 20 except for supplying no $CO_2$ gas at all. In EXAMPLE 21 and COMPARATIVE EXAMPLE 9, too, the casting was repeated 10 times.

Winding around a reel 8 was 100% success in the amorphous alloy ribbon of EXAMPLE 20 produced by starting to supply a $CO_2$ gas near a paddle of the alloy melt after 5 seconds from the start of casting, and in the amorphous alloy ribbon of COMPARATIVE EXAMPLE 9 produced without supplying a $CO_2$ gas, though success was as low as 10% in winding around a reel 8 in the amorphous alloy ribbon of EXAMPLE 21 produced by supplying a $CO_2$ gas since before the start of casting. However, the amorphous alloy ribbon of COMPARATIVE EXAMPLE 9 was poor in surface roughness.

The amorphous alloy ribbon of EXAMPLE 20 was heat-treated under the same conditions as in EXAMPLE 1, and observed by a transmission electron micrograph. As a result, it was found that it had a nano-crystalline structure having fine crystals having an average particle size of 100 nm or less. It was thus confirmed that this amorphous alloy ribbon was turned to a nano-crystalline alloy ribbon by a heat treatment.

EXAMPLES 22 and 23

An ingot of an alloy having a composition of $Si_9B_{13}Fe_{bal.}$ by atomic % was introduced into a crucible 1 shown in FIG. 1, and melted by induction heating by a high-frequency coil 2. The resultant alloy melt was ejected onto a cooling roll 5 made of a Cu—Be alloy and rapidly quenched, to produce an amorphous alloy ribbon 6 having a width of 40 mm and a thickness of 20 μm under the conditions shown in Table 12 below. The grinding of the cooling roll 5 was carried out by rotating a grinding brush 11 in the same direction as the cooling roll 5. The winding method of the resultant ribbon was the same as in EXAMPLE 1. The casting was repeated 10 times under the same conditions.

TABLE 12

| Casting Conditions | |
|---|---|
| Temperature of melt 3 | 1,300° C. |
| Peripheral speed of cooling roll 5 | 30 m/second |
| Distance D between tip end of melt-ejecting nozzle 4 and cooling roll 5 | 180 μm |
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 40 L/minute |
| Start of supplying $CO_2$ gas | After 5 seconds from start of casting |
| Grinding of cooling roll 5 | Grinding at peripheral speed of 5 m/second from immediately after start of casting to end of casting with 0.06-mm-diameter stainless steel wire brush |
| Distance L between paddle 10 and orifice of $CO_2$ gas-blowing nozzle 9 | 15 mm |
| Shape of orifice of $CO_2$ gas-blowing nozzle 9 | 40 mm in width direction of cooling roll 5 and 1 mm in rotation direction of cooling roll 5 |

The amorphous alloy ribbon 6 of EXAMPLE 23 was produced under the same conditions as in EXAMPLE 22 except for supplying a $CO_2$ gas at a flow rate of 30 L/minute since before the start of casting. In EXAMPLE 23, too, the casting was repeated 10 times under the same conditions.

100% success was achieved in winding around a reel 8 in the amorphous alloy ribbon of EXAMPLE 22 produced by starting to supply a $CO_2$ gas near a paddle of the alloy melt after 5 seconds from the start of casting. On the other hand, the percentage of success in winding was only 20% in the case of the amorphous alloy ribbon of EXAMPLE 23 produced under the conditions of continuing supplying a $CO_2$ gas from before the start of casting. It was thus found that by starting the supply of a $CO_2$ gas after 5 seconds from the start of casting, the resultant amorphous alloy ribbon was highly likely to be wound without breakage.

EXAMPLES 24 and 25

An ingot of an alloy having a composition of $Fe_{1.3}Mn_{3.7}Mo_{2.5}Si_{15}B_9Co_{bal.}$ by atomic % was introduced into a crucible 1 shown in FIG. 1, and melted by induction heating by a high-frequency coil 2. The resultant alloy melt 3 was ejected onto a cooling roll 5 made of a Cu—Be alloy and rapidly quenched to produce an amorphous alloy ribbon 6 of having a width of 40 mm and a thickness of 16 μm under the conditions shown in Table 13 below. The grinding of the cooling roll 5 was carried out by rotating the grinding brush 11 in the same direction as the cooling roll 5. The winding method of the resultant ribbon was the same as in EXAMPLE 1.

TABLE 13

| Casting Conditions | |
|---|---|
| Temperature of melt 3 | 1,250° C. (melting point of alloy: 1050° C.) |
| Peripheral speed of cooling roll 5 | 30 m/second |
| Distance D between tip end of melt-ejecting nozzle 4 and cooling roll 5 | 160 μm |

TABLE 13-continued

| Casting Conditions | |
|---|---|
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 40 L/minute |
| Start of supplying $CO_2$ gas | After 5 seconds from start of casting |
| Grinding of cooling roll 5 | Grinding at peripheral speed of 5 m/second from immediately after start of casting to end of casting with 0.08-mm-diameter brass wire brush |
| Distance L between paddle 10 and orifice of $CO_2$ gas-blowing nozzle 9 | 20 mm |
| Shape of orifice of $CO_2$ gas-blowing nozzle 9 | 50 mm in width direction of cooling roll 5 and 1.5 mm in rotation direction of cooling roll 5 |

The amorphous alloy ribbon 6 of EXAMPLE 25 was produced under the same conditions as in EXAMPLE 24 except for setting the peripheral speed of the cooling roll 5 at 40 m/second. However, the melt-ejecting nozzle 4 was provided with a large slit in EXAMPLE 25 to make the ribbon thickness substantially the same as in EXAMPLE 24.

Taken as samples from the ribbons of EXAMPLES 24 and 25 were portions obtained when 8 minutes passed from the start of casting, and their average surface roughness Ra was measured according to JIS B 0601 both on a freely solidified surface and on a side in contact with the cooling roll 5. The measurement results are shown in Table 14. It is clear from Table 14 that the surface roughness of the ribbon on a side in contact with the cooling roll 5 was susceptible to influence by the peripheral speed of the cooling roll 5.

TABLE 14

| | | | Average Surface Roughness Ra ($\mu$m) | |
|---|---|---|---|---|
| No. | Peripheral Speed of Cooling Roll | Supply of $CO_2$ Gas | Freely Solidified Surface | Surface in Contact with Roll |
| EXAMPLE 24 | 30 | Yes | 0.37 | 0.29 |
| EXAMPLE 25 | 40 | Yes | 0.57 | 0.46 |

Figure 8:
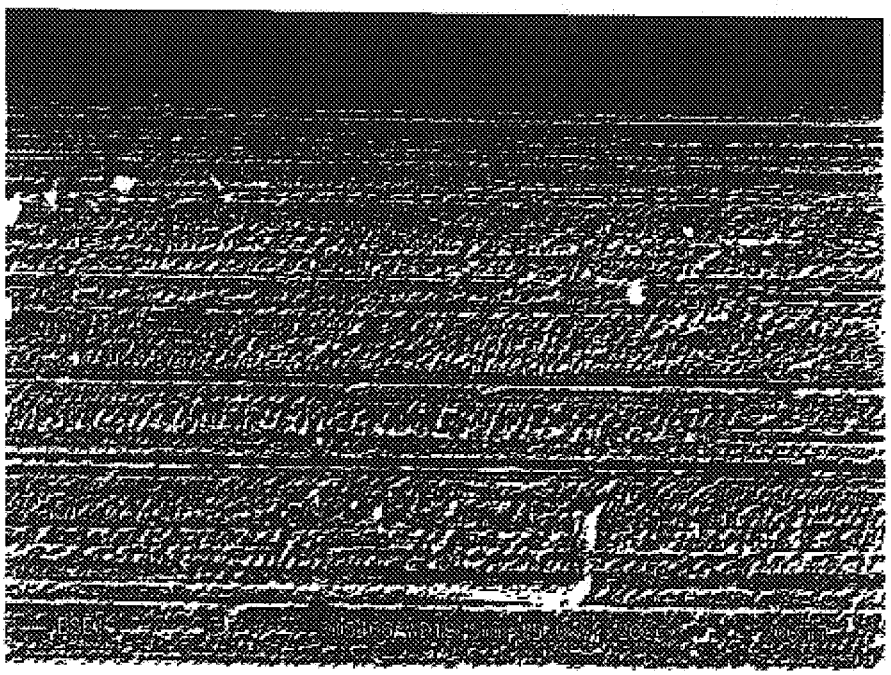
FIG. 8 is a scanning electron photomicrograph showing an edge portion of the amorphous alloy ribbon of EXAMPLE 24.
Figure 9:
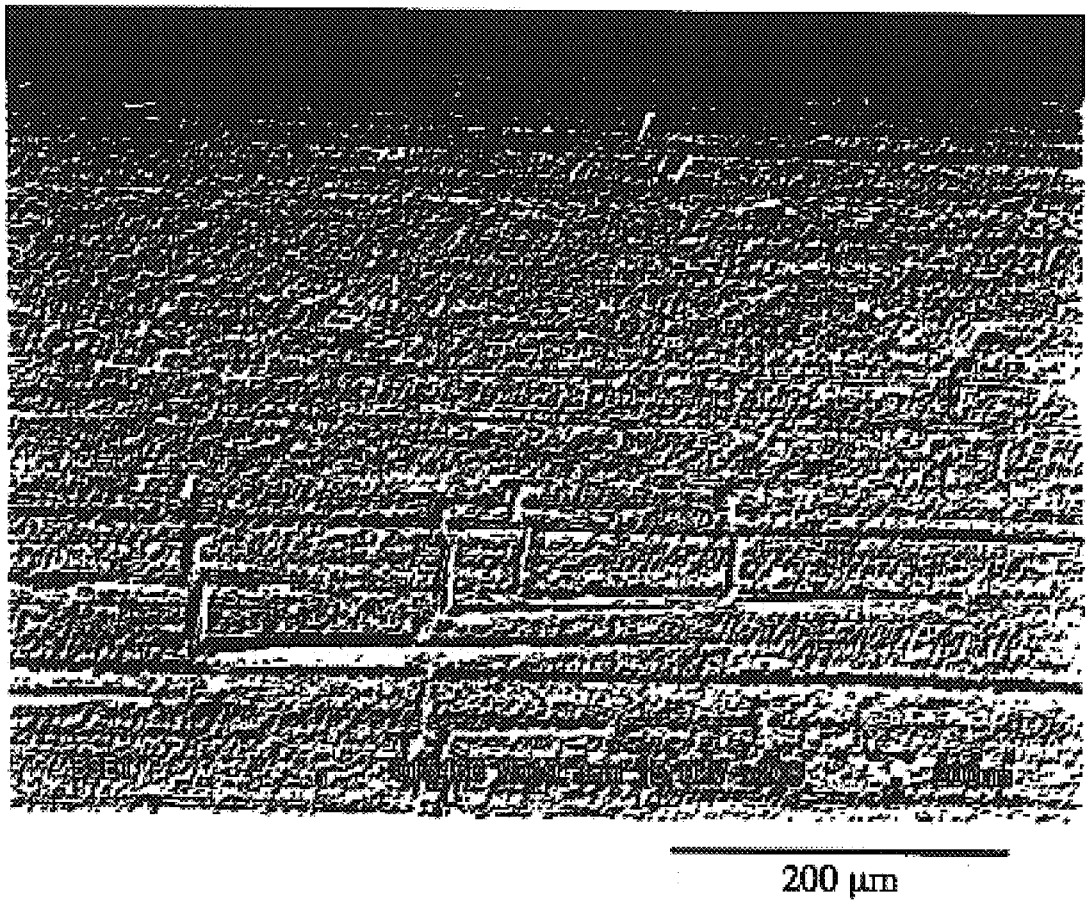
FIG. 9 is a scanning electron photomicrograph showing an edge portion of the amorphous alloy ribbon of EXAMPLE 25.

The ribbon edge shape of each amorphous alloy was observed by a scanning electron micrograph. The results are shown in FIGS. 8 and 9. It was found from FIGS. 8 and 9 that the ribbon produced under the conditions that the peripheral speed of the cooling roll 5 was 40 m/second had larger irregularity in edge shapes than the ribbon produced under the conditions that the peripheral speed of the cooling roll 5 was 30 m/second. Incidentally, no irregularity was observed in edge shapes in the ribbon obtained without supplying a $CO_2$ gas.

EXAMPLES 26–29, COMPARATIVE EXAMPLE 10

An ingot of an alloy having a composition of $Cu_1Nb_{2.5}Si_{13.5}B_7Fe_{bal.}$ by atomic % was introduced into a crucible 1 shown in FIG. 1, and melted by induction heating by a high-frequency coil 2. The resultant alloy melt 3 was ejected onto a cooling roll 5 made of a Cu—Be alloy and rapidly quenched, to produce amorphous alloy ribbons of EXAMPLES 26–29 each having a width of 35 mm and a thickness of 18.5 $\mu$m under the conditions shown in Table 15 below. The grinding of the cooling roll 5 was carried out by rotating the grinding brush 11 in the same direction as the cooling roll 5. The winding method of the resultant ribbon was the same as in EXAMPLE 1.

TABLE 15

| Casting Conditions | |
|---|---|
| Temperature of melt 3 | 1,230° C., 1,300° C., 1,390° C. (melting point of alloy: 1,150° C.) |
| Peripheral speed of cooling roll 5 | 30 m/second |
| Distance D between tip end of melt-ejecting nozzle 4 and cooling roll 5 | 150 $\mu$m |
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 32 L/minute |
| Start of supplying $CO_2$ gas | After 5 seconds from start of casting |
| Grinding of cooling roll 5 | Grinding at peripheral speed of 5 m/second from immediately after start of casting to end of casting with 0.08-mm-diameter brass wire brush |
| Distance L between paddle 10 and orifice of $CO_2$ gas-blowing nozzle 9 | 15 mm |
| Shape of orifice of $CO_2$ gas-blowing nozzle 9 | 45 mm in width direction of cooling roll 5 and 2 mm in rotation direction of cooling roll 5 |

Though the production of an amorphous alloy ribbon was attempted in COMPARATIVE EXAMPLE 10 under the same conditions as in EXAMPLE 26 except for setting the temperature of an alloy melt at 1,130° C., a nozzle was clogged after several seconds from the start of casting, failing to obtain an amorphous alloy ribbon. In addition, the amorphous alloy ribbon 6 of EXAMPLE 29 was produced under the same conditions as in EXAMPLE 26 except for setting the temperature of an alloy melt at 1,430° C.

Taken as samples from the resultant four types of amorphous alloy ribbons of EXAMPLES 26–29 were portions obtained when 8 minutes passed from the start of casting, and they were measured with respect to an average surface roughness Ra according to JIS B 0601 on a side in contact with the cooling roll 5. The results are shown in Table 16.

TABLE 16

| No. | Temperature of Alloy Melt (° C.) | Ra on Surface in Contact with Cooling Roll ($\mu$m) |
|---|---|---|
| EXAMPLE 26 | 1,230 | 0.32 |
| EXAMPLE 27 | 1,300 | 0.29 |
| EXAMPLE 28 | 1,390 | 0.33 |
| EXAMPLE 29 | 1,430 | 0.51 |

As is clear from Table 16, three types of amorphous alloy ribbons of EXAMPLES 26–28 cast from the alloy melts at preferred temperatures had an average surface roughness Ra of as small as less than 0.4 μm, the amorphous alloy ribbon of EXAMPLE 29 cast from the alloy melt at 1,430° C. had an average surface roughness Ra of 0.51 μm, about 1.5 times as large as those of EXAMPLES 26–28.

The amorphous alloy ribbons of EXAMPLES 26–29 were heat-treated under the same conditions as in EXAMPLE 1. The observation of the heat-treated ribbons by a transmission electron micrograph revealed that any of the heat-treated ribbons had a nano-crystalline structure containing fine crystals having an average particle size of 100 nm or less. It was confirmed from these results that these amorphous alloy ribbons were converted to nano-crystalline alloy ribbons by a heat treatment.

EXAMPLES 30 and 31

An ingot of an alloy having a composition of $Cu_1Nb_3Si_{15.5}B_{6.5}Fe_{bal.}$ by atomic % was introduced into a crucible 1 shown in FIG. 1, and melted by induction heating by a high-frequency coil 2. The resultant alloy melt 3 was ejected onto a cooling roll 5 made of a Cu—Be alloy and rapidly quenched to produce an amorphous alloy ribbon 6 of EXAMPLE 30 having a width of 20 mm and a thickness of 15 μm under the conditions shown in Table 17 below. The grinding of the cooling roll 5 was carried out by rotating the grinding brush 11 in the same direction as the cooling roll 5. The winding method of the resultant ribbon was the same as in EXAMPLE 1.

TABLE 17

| Casting Conditions | |
|---|---|
| Temperature of melt 3 | 1,350° C. (melting point of alloy: 1,135° C.) |
| Peripheral speed of cooling roll 5 | 25 m/second |
| Distance D between tip end of melt-ejecting nozzle 4 and cooling roll 5 | 120 μm |
| Position of $CO_2$ gas-blowing nozzle 9 | On upstream side of melt-ejecting nozzle 4 with $CO_2$ gas blown in radial direction of cooling roll 5 (see FIG. 2) |
| Flow rate of $CO_2$ gas | 40 L/minute |
| Start of supplying $CO_2$ gas | After 5 seconds from start of casting |

TABLE 17-continued

| Casting Conditions | |
|---|---|
| Grinding of cooling roll 5 | Grinding at peripheral speed of 5 m/second from immediately after start of casting to end of casting with 0.06-mm-diameter stainless steel wire brush |
| Distance L between paddle 10 and orifice of $CO_2$ gas-blowing nozzle 9 | 25 mm |
| Shape of orifice of $CO_2$ gas-blowing nozzle 9 | 30 mm in width direction of cooling roll 5 and 1 mm in rotation direction of cooling roll 5 |

The amorphous alloy ribbon 6 of EXAMPLE 31 was also produced under the same conditions as in EXAMPLE 30 except for setting the distance D between the tip end of the melt-ejecting nozzle 4 and the cooling roll 5 at 250 μm. In this case, the melt-ejecting nozzle 4 was provided with a small slit such that the thickness of the ribbon was substantially equal to that in EXAMPLE 30.

The ribbons of EXAMPLES 30 and 31 were measured with respect to an average surface roughness Ra according to JIS B 0601 both on a freely solidified surface and on a side in contact with the cooling roll 5. The results are shown in Table 18. As is clear from Table 18, when the distance D between the tip end of the melt-ejecting nozzle 4 and the cooling roll 5 was as small as 200 μm or less, the resultant amorphous alloy ribbon had small surface roughness.

Each of the amorphous alloy ribbons of EXAMPLES 30 and 31 was wound in a toroidal form to produce a wound core having an outer diameter 19 mm and an inner diameter of 15 mm. Each wound core was heat-treated at 520° C. for 1 hour in a non-reactive atmosphere to obtain a wound core of a nano-crystalline alloy ribbon having a nano-crystalline structure containing fine crystals having an average particle size of 100 nm or less.

Each wound core was provided with a primary winding of 10 turns and a secondary winding of 10 turns to measure a maximum permeability $\mu_{max}$ at 50 Hz. The results are also shown in Table 18. It was found from Table 18 that high permeability was obtained in a wound core formed by the nano-crystalline alloy ribbon of EXAMPLE 30 having a small average surface roughness Ra both on a freely solidified surface and a surface in contact with the cooling roll 5.

TABLE 18

| No. | Distance L between Tip End of Nozzle and Cooling Roll (μm) | Supply of $CO_2$ Gas | Ra (μm) Freely Solidified Surface | Ra (μm) Surface in Contact with Roll | Maximum Permeability $\mu_{max}$ at 50 Hz |
|---|---|---|---|---|---|
| EXAMPLE 30 | 120 | Yes | 0.31 | 0.32 | 744,000 |
| EXAMPLE 31 | 250 | Yes | 0.47 | 0.50 | 599,000 |

As described above in detail, the present invention has solved by grinding a cooling roll the problems of the embrittlement and crystallization of amorphous alloy ribbons and the irregular shapes in their edge portions occurring when they are mass-produced while supplying a $CO_2$ gas. Accordingly, the method of the present invention can continuously produce amorphous alloy ribbons substantially free from embrittlement, crystallization and irregular shapes in their edge portions without breakage. In addition, the amorphous alloy ribbons produced by the method of the present invention can be converted to nano-crystalline alloy ribbons having excellent magnetic properties by a heat treatment.

What is claimed is:

1. A method for producing an amorphous alloy ribbon by ejecting an alloy melt onto a cooling roll and rapidly quenching it, said amorphous alloy ribbon continuously produced in one casting step having the total length of 3,000 m or more, comprising grinding said cooling roll while supplying a gas based on $CO_2$ near a paddle of said alloy melt ejected onto said cooling roll so as to keep an average surface roughness Ra of 0.5 $\mu$m or less and a ten-point average surface roughness Rz of 4 $\mu$m or less during the casting when the surface roughness of said cooling roll is measured by a method according to JIS B 0601.

2. The method for producing an amorphous alloy ribbon according to claim 1, wherein the grinding of said cooling roll is carried out with a brush.

3. The method for producing an amorphous alloy ribbon according to claim 1, wherein an alloy melt comprising 13 atomic % or less of B and 15 atomic % or less of at least one element selected from the group consisting of transition elements of Groups 4A, 5A and 6A, the balance being substantially Fe, is ejected onto said cooling roll and rapidly quenched.

4. The method for producing an amorphous alloy ribbon according to claim 1, wherein said alloy melt contains 3 atomic % or less of at least one of Cu, Ag and Au.

5. The method for producing an amorphous alloy ribbon according to claim 1, wherein said gas based on $CO_2$ starts to be supplied near a paddle of said alloy melt after the surface temperature of said cooling roll has become substantially constant.

6. The method for producing an amorphous alloy ribbon according to claim 1, wherein said ribbon is cast under the conditions that the peripheral speed of said cooling roll is 35 m/second or less, that the temperature of said melt is from the melting point of its alloy +50° C. to the melting point of its alloy +250° C., and that a distance between a tip end of a melt-ejecting nozzle and said cooling roll is 200 $\mu$m or less.

7. The method for producing an amorphous alloy ribbon according to claim 6, wherein the peripheral speed of said cooling roll is 20–30 m/second.

8. The method for producing an amorphous alloy ribbon according to claim 1, wherein an amorphous alloy ribbon having a thickness of 8–25 $\mu$m is produced.

9. A method for producing a nano-crystalline alloy ribbon comprising heat-treating said amorphous alloy ribbon recited in claim 1 at a temperature equal to or higher than the crystallization temperature of said alloy, to form nano-crystalline structure having an average particle size of 100 nm or less.

10. A method for producing an amorphous alloy ribbon by ejecting an alloy melt onto a cooling roll and rapidly quenching it, said amorphous alloy ribbon continuously produced in one casting step having the total length of 3,000 m or more, comprising (a) preparing an alloy melt having a composition comprising 13 atomic % or less of B and 15 atomic % or less of at least one element selected from the group consisting of transition elements of Groups 4A, 5A and 6A, the balance being substantially Fe; (b) ejecting said alloy melt at a temperature from the melting point of said alloy +50° C. to the melting point of said alloy +250° C. through a nozzle onto said cooling roil rotating at a peripheral speed of 35 m/second or less, a distance between a tip end of said nozzle and said cooling roll being 200 $\mu$m or less; (c) starting to supply a gas based on $CO_2$ to said alloy melt after the surface temperature of said cooling roll has become substantially constant; and (d) grinding said cooling roil while supplying said gas based on $CO_2$.

* * * * *